US006227588B1

(12) United States Patent
Cassoni

(10) Patent No.: US 6,227,588 B1
(45) **Date of Patent: *May 8, 2001**

(54) GRIPPER ASSEMBLY

(75) Inventor: Robert Paul Cassoni, Centerville, OH (US)

(73) Assignee: Heidelberger Druckmaschinen Aktiengesellschaft, Heidelberger (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/251,861

(22) Filed: Feb. 17, 1999

(51) Int. Cl.[7] ..... B66C 1/42; B65G 47/86

(52) U.S. Cl. ..... 294/104; 294/99.1; 198/803.9

(58) Field of Search ..... 294/99.1, 104, 294/116; 271/204, 206, 268, 277; 198/803.3, 803.9

(56) References Cited

U.S. PATENT DOCUMENTS

| | | | | |
|---|---|---|---|---|
| 3,265,429 | * | 8/1966 | Shatt | 294/104 |
| 3,614,151 | * | 10/1971 | Shadle | 294/104 |
| 5,064,187 | * | 11/1991 | Muller | 294/99.1 |
| 5,374,093 | * | 12/1994 | Klopfenstein | 294/104 |
| 5,395,151 | * | 3/1995 | Eberle | 294/104 |
| 5,871,242 | * | 2/1999 | Whitney | 294/104 |

FOREIGN PATENT DOCUMENTS

0546512A1 6/1993 (EP) .

* cited by examiner

*Primary Examiner*—Dean J. Kramer
(74) *Attorney, Agent, or Firm*—Herbert L. Lerner; Laurence A. Greenberg; Werner H. Stemer

(57) ABSTRACT

A gripper assembly for clamping an article has a first clamp member mounted on a first shaft defining an axis and a second clamp member. An actuator for pivoting the first clamp member relative to the second clamp member around the first axis from an open position to a closed position in which the gripper is able to clamp an article is provided. The actuator has a follower link which is rotatably mounted on a second shaft defining a second axis different to that first axis. The actuator is coupled to the first clamp member by at least one guided compression spring.

10 Claims, 6 Drawing Sheets

GRIPPER ASSEMBLY

BACKGROUND OF THE INVENTION

Field of the Invention

The present invention relates to a gripper assembly for clamping a sheet material article such as a newspaper, a newspaper insert, a plurality of sheets or signatures, a magazine or the like that is to be transported by the gripper assembly.

Gripper systems are typically utilized by newspaper publishers for conveying newspapers, inserts or a plurality of sheets or signatures, hereinafter referred to as books, from one location to another. A gripper of that kind is known, for example, from European patent document EP 0 546 512 which describes a gripper assembly for clamping articles. The gripper assembly according to this document has a first and second clamp member where the second clamp member is able to pivot relative to the first clamp member where a coil or compression spring is compressed when the second clamp member is in its open position. To hold the second clamp member in the closed position it is necessary to provide a latch means. This latch means must be able to resist the torque that results from the entire clamp force. This configuration, however, suffers from its relatively inefficient clamping force. Furthermore, it is difficult to custom tailor grippers to specific applications and to create matched springs between right-hand and left-hand sides of the gripper.

SUMMARY OF THE INVENTION

It is therefore an object of the present invention to provide a new and improved gripper assembly especially for gripping a plurality of sheets or signatures, newspapers, magazines or the like and further avoids a marking of the product.

A first aspect of the present invention is directed to a gripper assembly for clamping an article comprising a first clamp member mounted on a first shaft defining a first axis, a second clamp member, an actuator for pivoting said first clamp member relative to said second clamp member around said first axis from an open position to a closed position in which said gripper assembly is able to clamp an article, said actuator having a follower link being rotatably mounted on a second shaft defining a second axis different to said first axis, said actuator being coupled to said first clamp member by at least one guided compression spring.

According to another aspect of the present invention a gripper assembly for clamping an article comprises a plurality of first clamp members mounted on a first shaft defining a first axis, a second clamp member, a plurality of first actuators for pivoting each of said first clamp members relative to that second clamp member around said first axis independently from each other from an open position to a closed position in which said gripper assembly is able to clamp an article having a follower link and being rotatably mounted on a second shaft defining a second axis different to said first axis and where one of each of said plurality of actuators is coupled to one corresponding first clamp member by at least one guided compression spring.

A further aspect of the present invention is directed to a method for clamping an article with a gripper assembly comprising a first clamp member mounted on a first shaft defining a first axis, a second clamp member, an actuator for pivoting said first clamp member relative to said second clamp member around said first axis from an open position to a closed position in which said gripper assembly is able to clamp an article, said actuator having a follower link being rotatably mounted on a second shaft defining a second axis different to said first axis, said actuator being coupled to said first clamp member by at least one guided compression spring where the first clamp member is pivoted relative to said second clamp member around said first axis by said actuator from an open position to a closed position in which said gripper assembly is able to clamp an article, said actuator having a follower link being rotated about said second shaft, moving the center of a base spring shaft extending through a hole of said follower link along a continuous circle, continuously increasing the compression of a compression spring during the circular movement of said center of said base spring shaft and closing the gripper assembly by moving said center of said base spring shaft across a straight line between the center of the second shaft and the center of a spring boss shaft extending through a spring shaft boss mounted on said first clamp member.

The foregoing and other objects and the features of the present invention will become more apparent upon a consideration of the following description taken into connection with the accompanying drawings.

DESCRIPTION OF THE PREFERRED EMBODIMENTS

Figure 1:
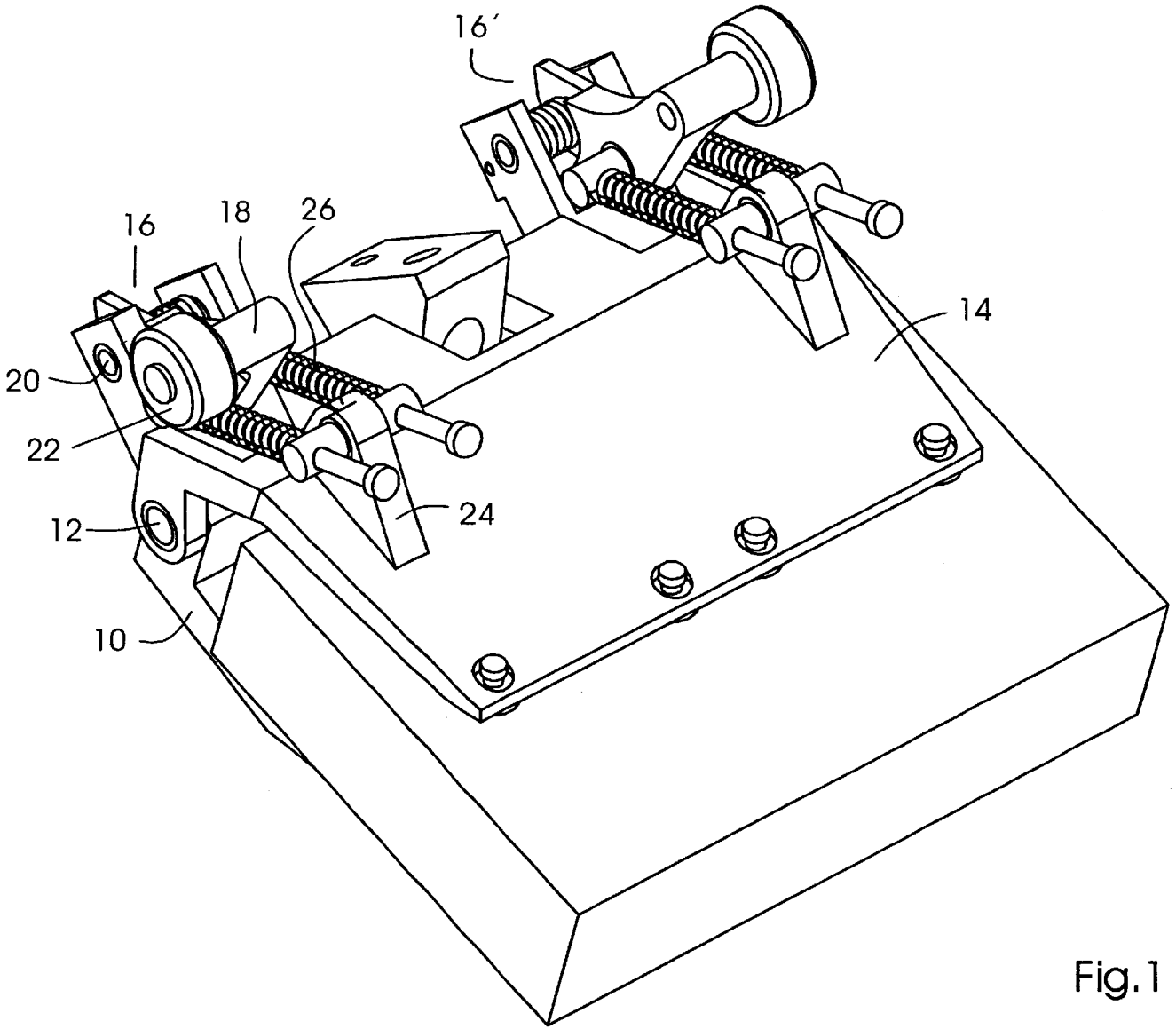
FIG. 1 is a perspective view of the gripper assembly.

Referring now more in detail to the drawings and particularly to FIG. 1, a gripper assembly according to the present invention may include a first clamp member 14 mounted on a first shaft 12 defining a first axis. A second clamp member 10 is provided and preferably rotatably coupled to the first shaft 12 in order to rotate the first clamp member 14 around the first shaft 12 relative to the second clamp member 10. An actuator 16 is provided and includes a follower link 18 being rotatably mounted on a second shaft 20, the so-called actuator pivot shaft defining a second axis. The follower link 18 is further coupled to a spring shaft boss 24 by a compression spring 26 where the spring shaft boss 24 is mounted on the second clamp member. The follower link 18 furthermore comprises a follower roller 22 which being able to engage cam means along the gripper conveyor to pivot the follower link 18 around the second axis 20 relative to the second clamp member 14 and thereby closing the gripper assembly as will be described in more detail below. A second actuator 16' similar to the first actuator 16 may be provided if desired, but need not to be provided.

As shown in FIG. 1 the first clamp member 14 is rotatably mounted on a first shaft 12 and may be pivoted about the shaft 12 relative to the second clamp member 10. In a second embodiment of the invention the first clamp member 14 may be replaced by a plurality of first clamp members where an example of this embodiment is given in FIG. 2.

Figure 2:
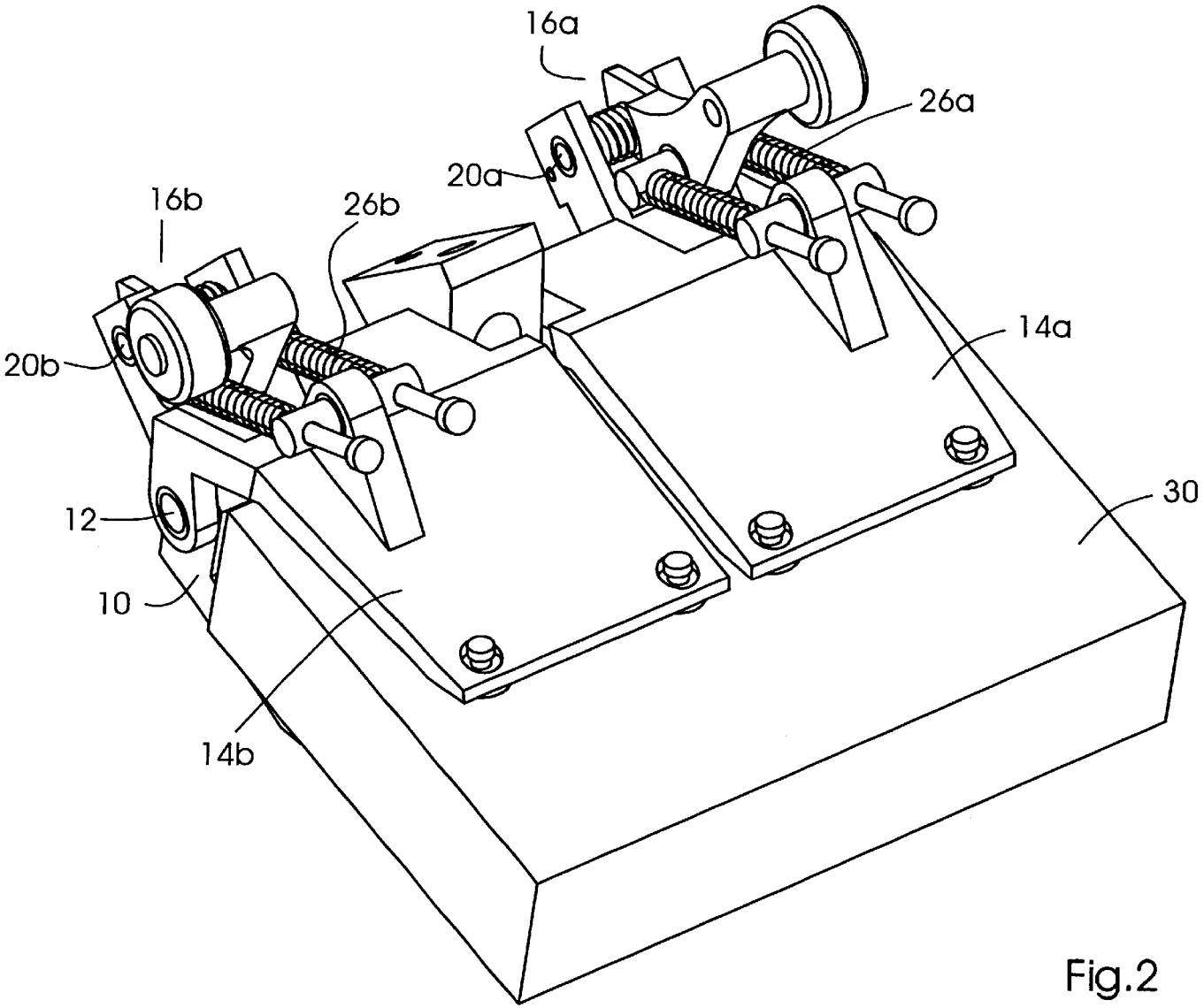
FIG. 2 is a perspective view of a split face gripper assembly having two first clamp members.

According to FIG. 2 the gripper assembly shows a first and second split clamp member 14*a*, and 14*b* where each of the split clamp members 14*a* and 14*b* is rotatably mounted on a first shaft 12 and each of the split clamp members 14*a*, 14*b* may rotate about the first shaft 12 relative to a second clamp member 10, independently from each other. This rotational movement causes the gripper to open or close on the book 30. Each of the split clamp members 14*a* and 14*b* is associated with a corresponding actuator 16*a*, 16*b* where each of the actuators 16*a*, 16*b* is rotatably mounted on a corresponding second shaft 20*a*, 20*b*. The shafts 20*a*, 20*b* are substantially parallel to the first shaft 12. As further shown in FIG. 2 each of the actuators 16*a*, 16*b* is coupled to its corresponding split clamp member 14*a*, 14*b* by associated compression springs 26*a* and 26*b*.

Replacing a single first clamp member by a plurality of first clamp members leads to a split of the first clamp member into a plurality of individual "faces". The example given in FIG. 2 shows a split-faced gripper having two individual split clamp members or faces that are completely independent of each other, allowing to cope with thickness variations across the book width and therefore allowing to compensate an uneven insert distribution.

Figure 3:
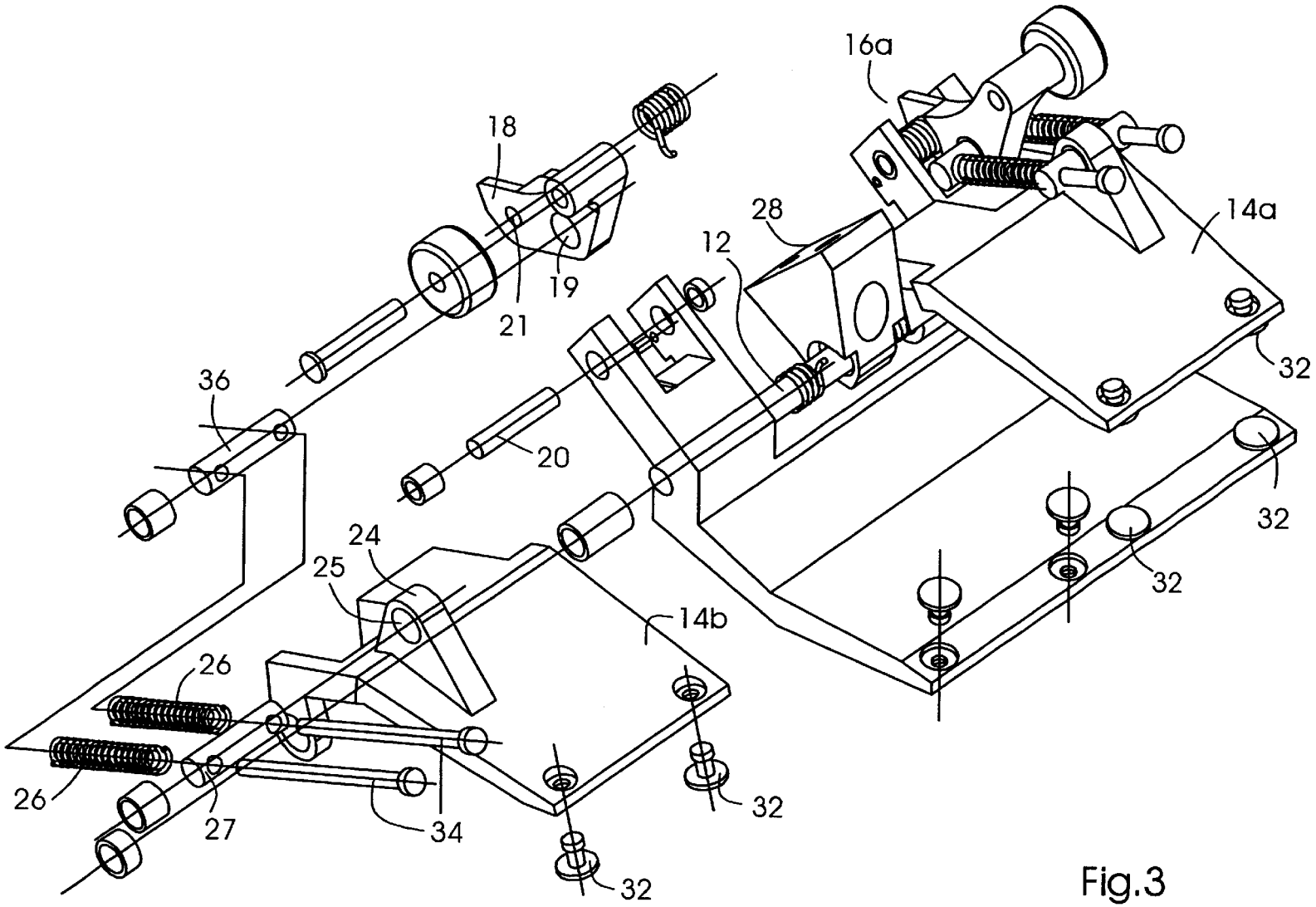
FIG. 3 is a detailed view of the gripper assembly.
Figure 6:
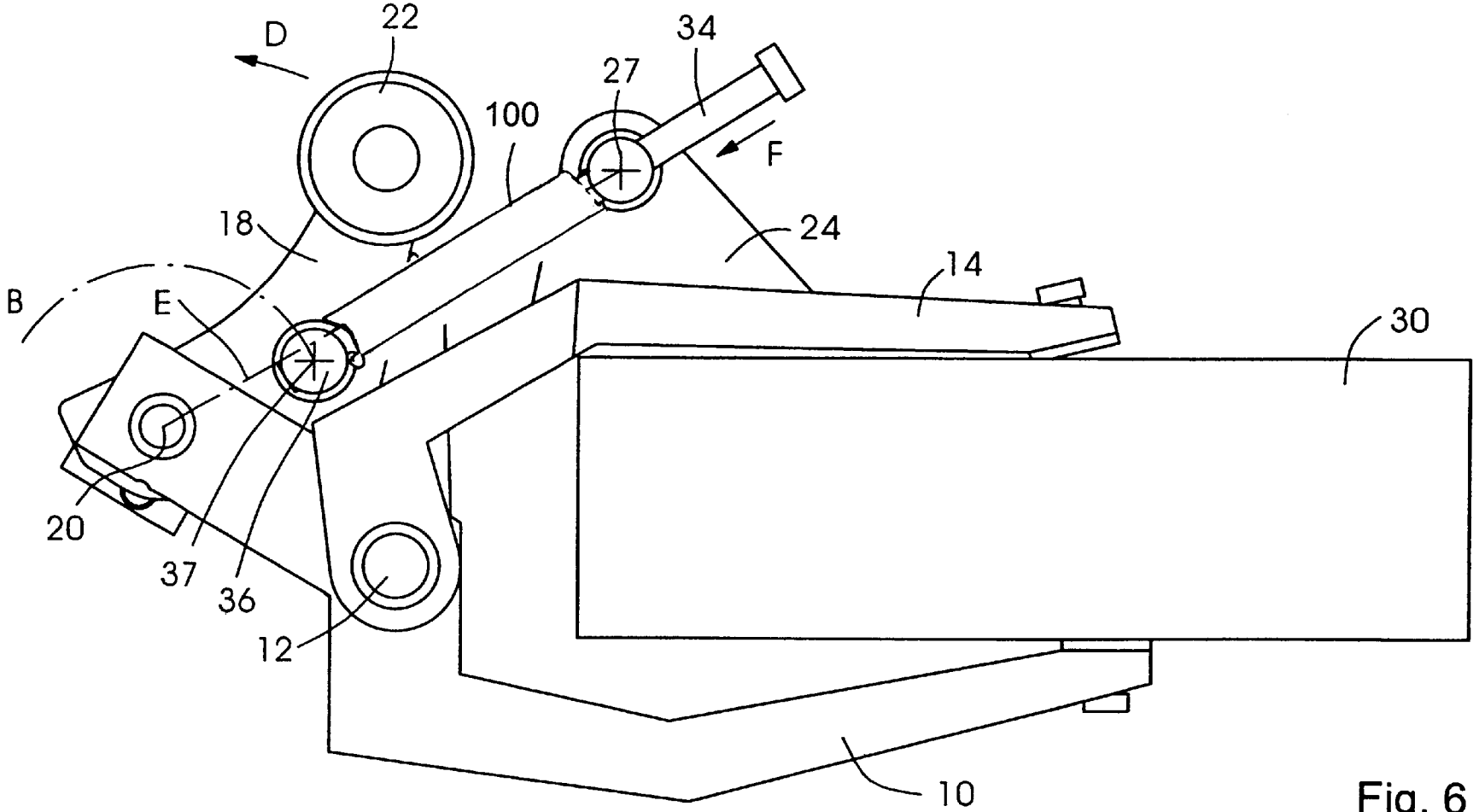
FIG. 6 is a side view of the gripper assembly in a closed position showing a sleeve guiding a compression spring.

Referring now to FIG. 3 the components of a split-faced gripper according to the present invention are given in more detail. As already described above, the gripper assembly may comprise two first clamp members 14*a* and 14*b*. As the components of each of the split clamp members and each of the actuators associated with the split clamp member 14*a* and 14*b* are the same the following description refers only to one of the split clamp members and one of the actuators. Both the first and second split clamp members are mounted on the first shaft 12 and are separated by a pivot mount block 28 which is provided to couple the gripper assembly to a conveyor. Each of the split clamp members may include a plurality of grip bumpers 32 which improve the sure grip of a book. Furthermore, each of the split clamp members may comprise a spring shaft boss 24 having a hole 25 therein and a spring boss pivot shaft 27 extending through the hole 25 of the spring shaft boss 24. The spring boss pivot shaft 27 may comprise two holes which are preferably arranged symmetrical to the center of the shaft 27 and a spring mandrel 34 extends through each hole of the shaft 27. The spring mandrel 34 furthermore extends through the center of the compression spring 26, and therefore guides the compression spring 26. Each of the actuating means 16*a*, 16*b* of the present invention comprises a follower link 18, a first hole 19 arranged in the follower link for receiving a base spring shaft 36 and a second hole 21 arranged in the follower link 18 for receiving the second shaft 20, the so-called follower shaft. Each spring mandrel 34 extends through the center of the compression spring 26 and further through a corresponding hole which extends through the base spring shaft. In this way, each actuator 16*a*, 16*b* is coupled with a corresponding split clamp member 14*a*, 14*b*. The compression spring 26 is guided by the spring mandrel 34. As shown in FIG. 6, it is possible to replace the spring mandrel extending through the inner of the spring by a sleeve 100 which guides the spring (hidden by the sleeve 100 shown in FIG. 6.) by muffling it.

Figure 4:
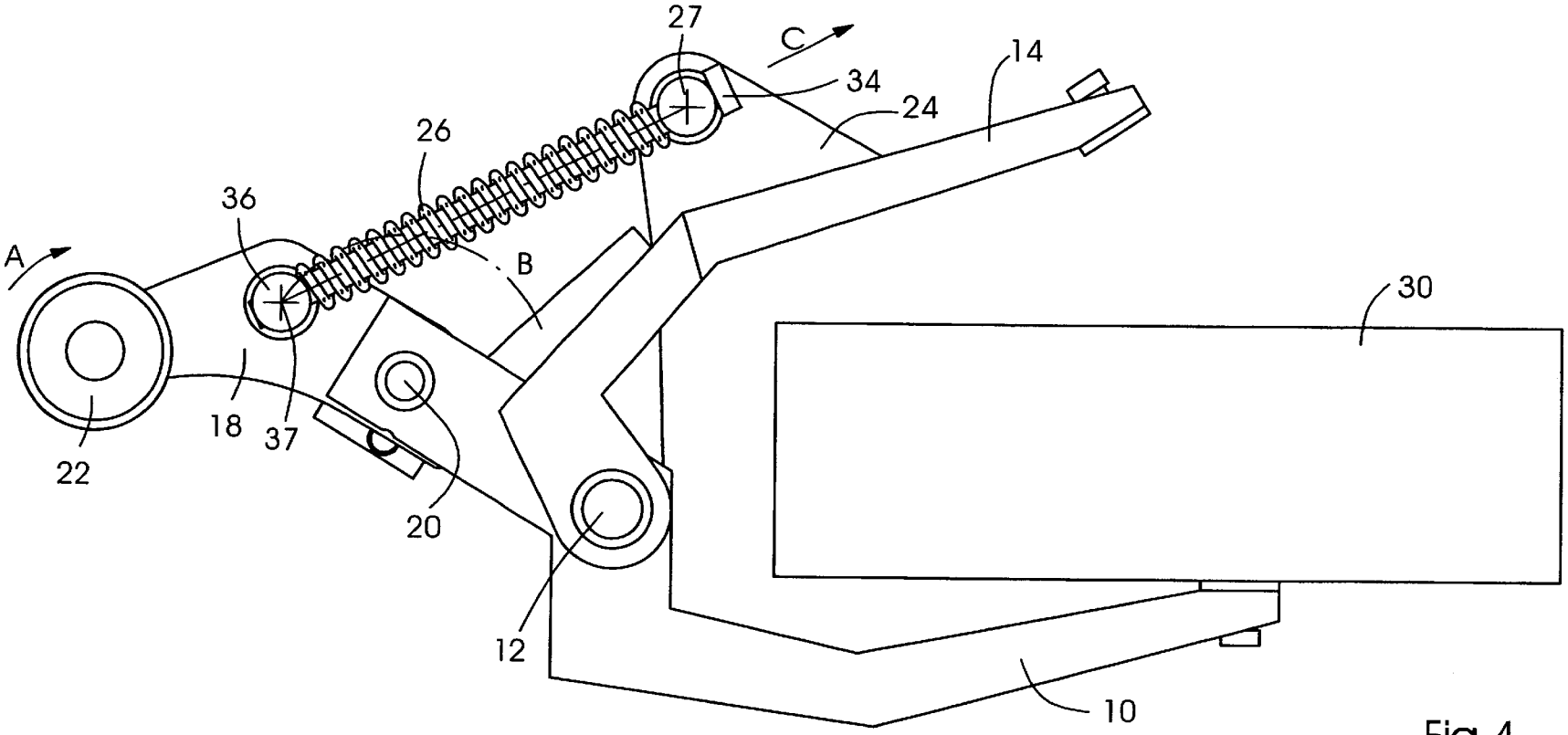
FIG. 4 is a side view of the gripper assembly in an open position.
Figure 5:
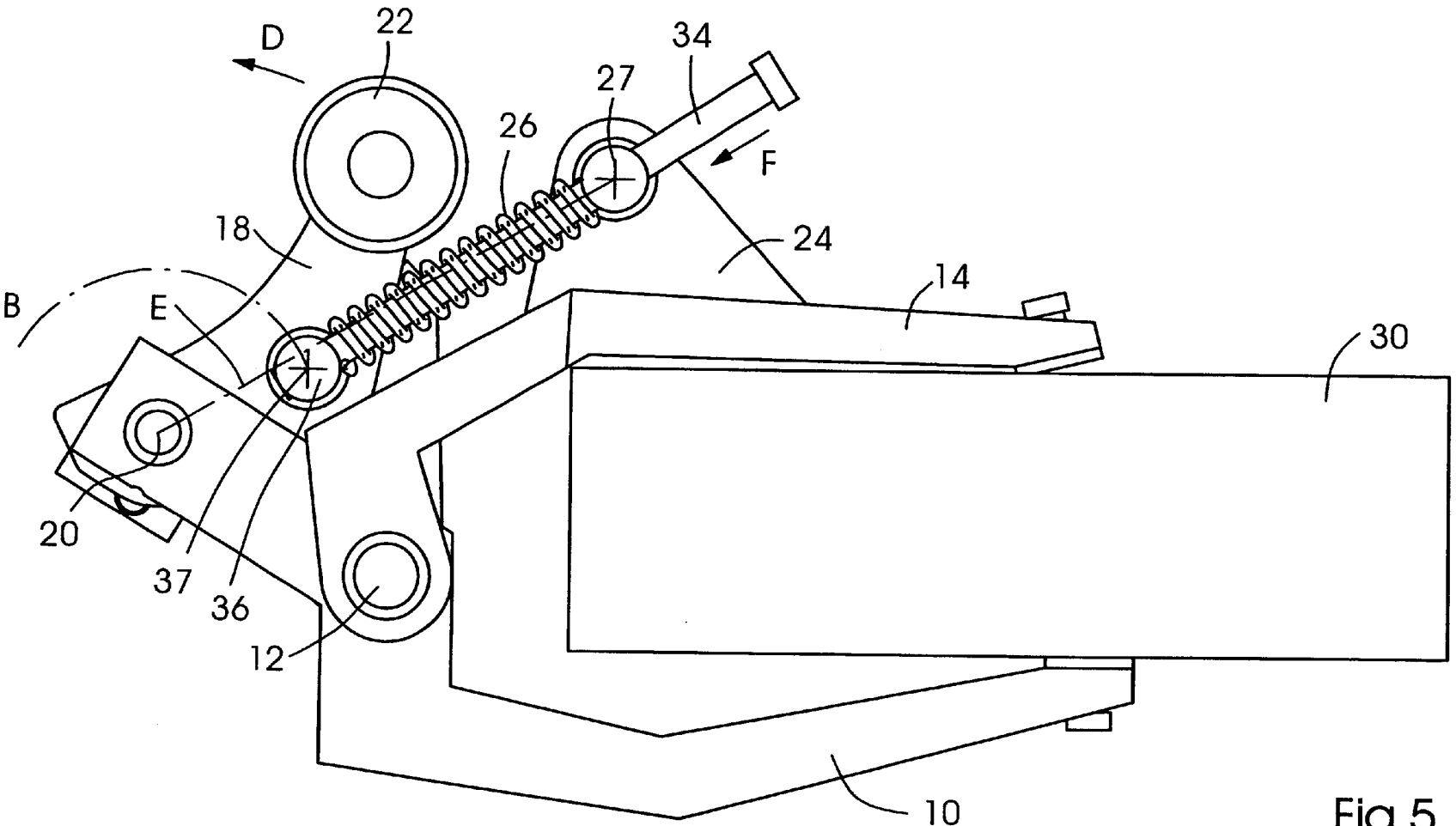
FIG. 5 is a side view of the gripper assembly in a closed position.

The function of the gripper assembly will now be described in greater detail in connection with the FIGS. 4 and 5. FIG. 4 shows a side view of the gripper assembly according to the present invention in an open condition. The follower link 18 is in its back position and the first clamp member 14 and the second clamp member 10 are in an open condition. The compression spring 26 which extends between the base spring shaft 36 and the spring boss pivot shaft 27 may be pre-loaded but is preferably in an uncompressed condition, while the spring mandrel 34 extends substantially between the base spring shaft 36 and the pivot shaft 27. A movement of the follower roller 22 indicated by the arrow A causes the follower link 18 to rotate around the second shaft 20. The rotational movement of the follower link 18 causes a circular movement of the center 37 of the base spring shaft 36 along the circle B. When the circular movement proceeds the compression of the spring 26 increases as the spring mandrel 34 is pushed in the direction given by the arrow C.

This means that in case the compression spring is in an uncompressed condition when the gripper is open it changes into a compressed condition, when the gripper is closed. In case the compression spring 26 is pre-loaded in the open position of the gripper assembly the spring-load, however, increases continuously during closing the gripper. This movement continues until, as shown in FIG. 5, a book 30 is clamped between the first clamp member 14 and the second clamp member 10, where the compression of spring 26 increases as a result of the rotational movement of the first clamp member 14 around the first shaft 12 relative to the first clamp member 10. The gripper assembly has reached its close position at the time when the center 37 of the base spring shaft 36 has reached a position which is below a straight line E between the center of the second shaft 20 and the center of the spring boss pivot shaft 27.

To open the gripper the follower roller 22 is moved in the direction indicated by the arrow D which again causes a circular movement of the follower link 18 around shaft 20. This in turn will cause the center 37 of the base spring shaft 36 to move along the circle B in the direction of the open position which has already been described in connection with FIG. 4. Upon proceeding movement of the follower link 18 compression of the spring 36 decreases continuously again and the center 37 of the base spring shaft 36 crosses a straight line, indicated by a dotted line E, between the center of the second shaft 20 and the center of the spring boss pivot shat 37 which loosens the clamp on the book 30 at this point.

Upon further rotation of the follower link 18 the compression spring 26 proceeds to decrease in compression while the spring mandrel 34 moves in the direction given by the arrow F. The gripper assembly has reached its full open position and all components have reached their initial position shown in FIG. 4 in which the gripper assembly is ready to clamp an article again.

Without further analysis the foregoing will so fully reveal the gist of the present invention that others can applying current knowledge readily adapted for various application without omitting features that from the stand point of prior art, fairly constitute essential characteristics of the generic or specific aspects of this invention and therefore such adaptations should and are intended to be comprehended within a meaning and range of equivalence of the following claims.

I claim:

1. A gripper assembly for clamping an article, comprising:

a first clamp member mounted on a first shaft defining a first axis;

a second clamp member mounted on the first shaft;

at least one guided compression spring;

and an actuator for pivoting said first clamp member relative to said second clamp member around said first axis from an open position to a closed position in which said gripper assembly is able to clamp an article;

said actuator having a follower link being rotatably mounted on a second shaft defining a second axis different to said first axis, said actuator being coupled to said first clamp member by said at least one guided compression spring;

said at least one guided compression spring being in a more compressed condition when said first clamp member is in the closed position than when said first clamp member is in the open position;

said follower link, comprising a hole and a first spring shaft extending through said hole, said compression spring being coupled to said first spring shaft; and said first clamp member comprising a spring shaft boss having a hole formed therein and a second spring shaft extending through said hole, said compression spring being coupled to said second spring shaft.

2. The gripper assembly according to claim 1, wherein said first axis is substantially parallel to said second axis.

3. The gripper assembly according to claim 1, wherein said compression spring is in an uncompressed condition in the open position and changes into a compressed condition in said closed position.

4. The gripper assembly according to claim 1, wherein said compression spring is in a pre-loaded condition in the open position and changes into a more compressed condition in said closed position.

5. The gripper assembly according to claim 1, comprising a second guided compression spring being arranged parallel to said first guided compression spring.

6. The gripper assembly according to claim 1, wherein each of said at least one guided compression springs is guided by a shaft extending through said spring.

7. The gripper assembly according to claim 1, wherein each of said at least one guided compression springs is guided by a sleeve.

8. A method for clamping an article with a gripper assembly according to claim 1, which comprises the steps of:

rotating the follower link around the second shaft and thereby moving the center of a base spring shaft extending through a hole of said follower link along a continuous circle;

continuously increasing the compression of a compression spring during the circular movement of said center of said base spring shaft;

closing the gripper assembly by moving said center of said base spring shaft across a straight line between the center of the second shaft and the center of a spring boss shaft extending through a spring shaft boss mounted on said first clamp member.

9. A gripper assembly for clamping an article, comprising a plurality of first clamp members mounted on a first shaft defining a first axis, a second clamp member, a plurality of guided compression springs, and a plurality of first actuators for pivoting each of said first clamp members relative to said second clamp member around said first axis independently from each other from an open position to a closed position in which said gripper assembly is able to clamp an article, each of said actuators having a link and being rotatably mounted on a second shaft defining a second axis different to said first axis, each of said actuators being coupled to one corresponding first clamp member by at least one of said plurality of guided compression springs.

10. The gripper assembly according to claim 9, wherein each of said plurality of first clamp members is able to rotate independently from each other.

* * * * *